US012595804B2

(12) United States Patent
Rimmer

(10) Patent No.: US 12,595,804 B2
(45) Date of Patent: Apr. 7, 2026

(54) HOUSING JOINTS WITH COMPRESSION LOADED GRAPHITE SEALS FOR DOWNHOLE ESP USE

(71) Applicant: Halliburton Energy Services, Inc., Houston, TX (US)

(72) Inventor: Michael Rimmer, Frimley (GB)

(73) Assignee: Halliburton Energy Services, Inc., Houston, TX (US)

( * ) Notice: Subject to any disclaimer, the term of this patent is extended or adjusted under 35 U.S.C. 154(b) by 48 days.

(21) Appl. No.: 18/114,744

(22) Filed: Feb. 27, 2023

(65) Prior Publication Data

US 2024/0287996 A1 Aug. 29, 2024

(51) Int. Cl.
*F04D 13/10* (2006.01)
*E21B 43/12* (2006.01)
*F04D 29/08* (2006.01)

(52) U.S. Cl.
CPC ..... *F04D 29/086* (2013.01); *E21B 43/128* (2013.01); *F04D 13/10* (2013.01)

(58) Field of Classification Search
CPC ..... F04D 29/086; F04D 13/10; E21B 43/128; F04B 47/06
See application file for complete search history.

(56) References Cited

U.S. PATENT DOCUMENTS 2,032,838 A * 3/1936 Eaton ..... F04B 47/00 92/168
2,151,200 A * 3/1939 Goodrie ..... E03C 1/102 251/118
2,863,680 A * 12/1958 Taltavall, Jr. ..... F16J 15/344 277/352
4,350,346 A * 9/1982 Fowler ..... F16J 15/20 277/627
4,548,265 A * 10/1985 Luke ..... E21B 33/1208 285/376
4,665,978 A * 5/1987 Luke ..... E21B 36/00 277/340

(Continued)

FOREIGN PATENT DOCUMENTS

CN 205638328 U 10/2016
CN 207961522 U 10/2018
GB 2554611 A 4/2016

OTHER PUBLICATIONS

Foreign Communication from Related Application—International Search Report and Written Opinion of the International Searching Authority, International Application No. PCT/US2023/014062 dated Nov. 14, 2023, 11 pages.

*Primary Examiner* — Thomas Fink
(74) *Attorney, Agent, or Firm* — Conley Rose, P.C.; Rodney B. Carroll

(57) ABSTRACT

A seal mechanism for an electric submersible pump (ESP) assembly comprising a graphite ring installed on a first component with an installation configuration and a sealing configuration. The graphite ring is installed on an external sealing surface of a first component. An internal sealing surface of a second component is aligned with the graphite ring. An activation force transitions the graphite ring from the installation configuration to a sealing configuration wherein the graphite ring forms a seal to the external sealing surface of the first component and the internal sealing surface of the second component.

21 Claims, 8 Drawing Sheets

(56) References Cited

U.S. PATENT DOCUMENTS

| | | | | |
|---|---|---|---|---|
| 4,826,217 | A * | 5/1989 | Guerrero | G21C 13/036 976/DIG. 173 |
| 4,911,480 | A * | 3/1990 | Bridges | E21B 33/03 285/123.6 |
| 9,284,229 | B2 | 3/2016 | Zhao et al. | |
| 9,505,151 | B2 | 11/2016 | Xu et al. | |
| 10,001,214 | B2 | 6/2018 | Zhao et al. | |
| 10,233,376 | B2 | 3/2019 | Zhao et al. | |
| 10,330,200 | B2 | 6/2019 | Zhao et al. | |
| 2009/0145612 | A1 | 6/2009 | Olson et al. | |
| 2009/0223661 | A1* | 9/2009 | Khazanovich | E21B 33/02 166/93.1 |
| 2010/0139077 | A1 | 6/2010 | Linzell | |
| 2013/0098632 | A1* | 4/2013 | Wetzel | E21B 43/128 166/85.1 |
| 2013/0340245 | A1* | 12/2013 | Watson | F04D 13/08 29/592.1 |
| 2015/0204169 | A1 | 7/2015 | Coates et al. | |
| 2017/0074083 | A1* | 3/2017 | Morton, III | E21B 43/38 |
| 2019/0010782 | A1* | 1/2019 | Parkins | E21B 34/08 |
| 2019/0010952 | A1* | 1/2019 | Welschinger | F04D 1/00 |
| 2020/0141529 | A1* | 5/2020 | Charles | E21B 33/1216 |
| 2021/0033089 | A1* | 2/2021 | Rutter | F04D 29/406 |
| 2022/0056767 | A1* | 2/2022 | Part | E21B 17/0285 |
| 2024/0240528 | A1* | 7/2024 | Bencze | E21B 17/028 |

* cited by examiner

HOUSING JOINTS WITH COMPRESSION LOADED GRAPHITE SEALS FOR DOWNHOLE ESP USE

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Equipment for downhole deployment in the oil and gas industry may utilize several types of elastomeric parts to exclude wellbore fluids. Electric submersible pumps (ESPs) for artificial lift, for example, may include elastomeric gaskets, flange seals, o-rings, bladders, labyrinth seals, tubes, and so forth. An elastomeric seal, e.g., an o-ring, may be installed in the gland of a hardware component of an ESP to keep outside well fluids away from internal dielectric lubricants. For more severe environments, conventional elastomeric components may be replaced by high-temperature thermoplastics, e.g., perfluoroelastomers, or metal-to-metal seals which can provide enhanced resistance to many chemicals and greater resistance to high-temperature working fluids.

In many high-temperature environments, for example temperature above 300° C., e.g., steam assisted gravity drainage (SAGD) or steam flooding, the aging rate of high-temperature elastomers can be drastically accelerated by temperature. Metal-to-metal seals typically require tight tolerances and may be susceptible to metal fatigue. Metal-to-metal seals can require a clean environment and special tools during assembly. A high temperature seal that utilizes the same type of seal glands as elastomeric type seals is desirable.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
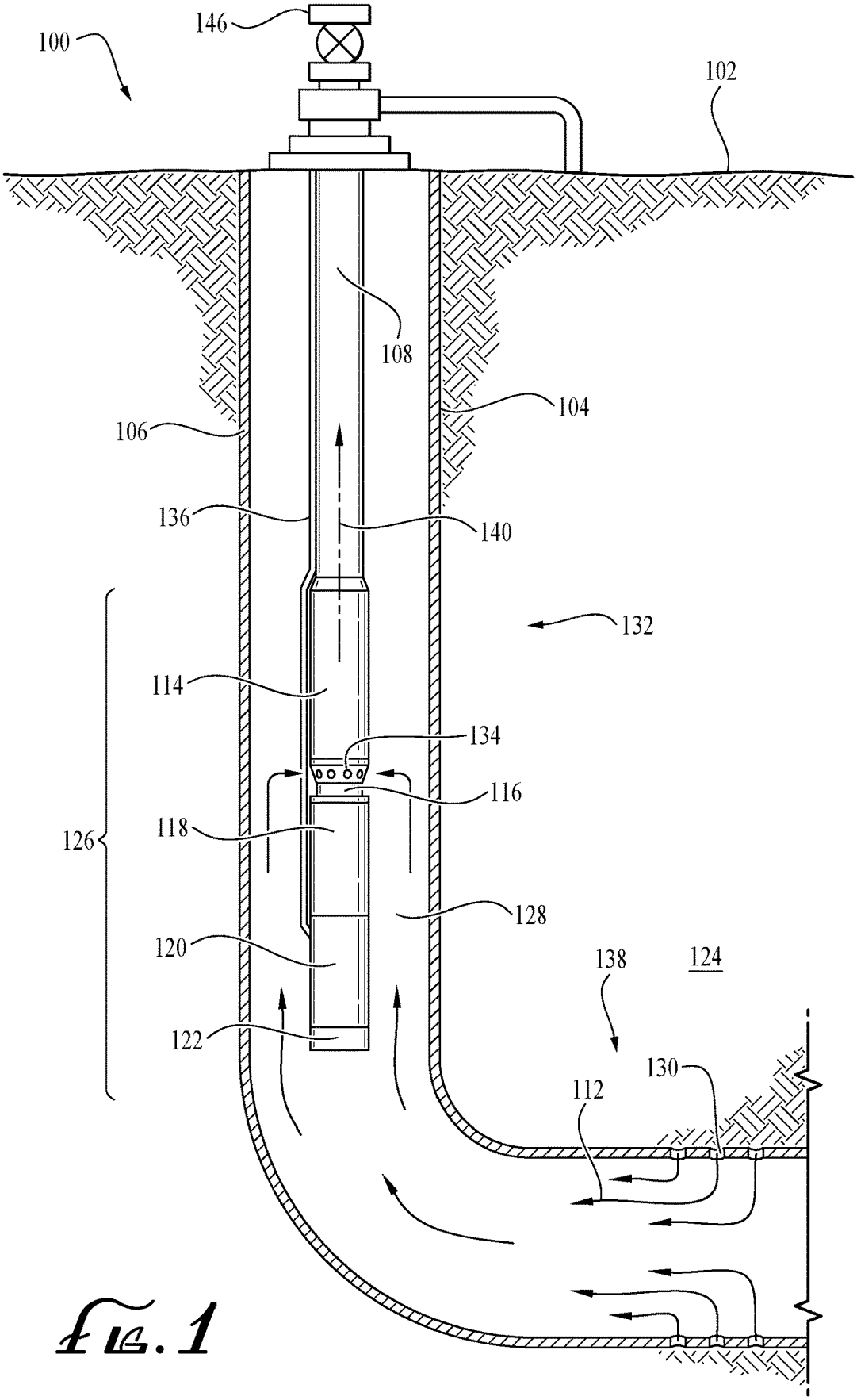
FIG. 1 is an illustration of an electric submersible pump (ESP) assembly in a wellsite environment according to an embodiment of the disclosure.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

As used herein, orientation terms "uphole," "downhole," "up," and "down" are defined relative to the location of the earth's surface relative to the subterranean formation. "Down" and "downhole" are directed opposite of or away from the earth's surface, towards the subterranean formation. "Up" and "uphole" are directed in the direction of the earth's surface, away from the subterranean formation or a source of well fluid. "Fluidically coupled" means that two or more components have communicating internal passageways through which fluid, if present, can flow. A first component and a second component may be "fluidically coupled" via a third component located between the first component and the second component if the first component has internal passageway(s) that communicates with internal passageway(s) of the third component, and if the same internal passageway(s) of the third component communicates with internal passageway(s) of the second component.

Hydrocarbons, such as oil and gas, are produced or obtained from subterranean reservoir formations that may be located onshore or offshore. The development of subterranean operations and the processes involved in removing hydrocarbons from a subterranean formation typically involve a number of construction steps such as drilling a wellbore at a desired well site, isolating the wellbore with a barrier material, completing the wellbore with various production equipment, treating the wellbore to optimize production of hydrocarbons, and providing surface production equipment for the recovery of hydrocarbons from the wellhead.

During production operations, artificial lift systems, for example, electric submersible pump (ESP) systems, may be used when reservoir pressure alone is insufficient to produce hydrocarbons from a well or is insufficient to produce the hydrocarbons at a desirable rate from the well. An ESP system is typically transported to the wellsite in sections assembled, attached to the production tubing, and conveyed into the wellbore by the production tubing to a target depth. The typical ESP system is configured with the pump section coupled to the production tubing with the motor section downhole or below the pump section. A power cable is typically mounted or strapped along the outside of the production tubing to provide electrical power to the electric motor of the ESP system.

A typical motor section of an ESP system can be filled with a dielectric fluid for cooling and lubrication. The motor section typically uses seals to prevent wellbore fluids from contaminating the dielectric fluid and possibly initiating a cascading failure of the electric motor. Typical elastomer seals have temperature limit and high-temperature elastomer seals are costly. It is desirable to source a low-cost seal for high-temperature applications.

Graphite seals can provide a solution for a low-cost seal with high-temperature applications. Graphite seals are relatively low cost, e.g., $8 USD each, compared to high-temperature FFKM O-rings, e.g., $75 USD each. Graphite seals can operate at temperatures up to 550° C. and with high pressures. In addition, graphite seals are inert to most forms of chemical attack.

Turning now to FIG. 1, a wellsite environment 100 is illustrated. In some embodiments, wellsite environment 100 comprises a wellbore 104 extending from a surface 102 to a permeable formation 124. The wellbore 104 can be drilled from surface 102 using any suitable drilling technique. The wellbore 104 can include a substantially vertical portion 132 that transitions to a deviated portion and into a substantially horizontal portion 138. In some embodiments, the wellbore 104 may comprise a nonconventional, horizontal, deviated, multilateral, or any other type of wellbore. Wellbore 104 may be defined in part by a casing string 106 that may extend from a surface 102 to a selected downhole location. Portions of wellbore 104 that do not comprise the casing string 106 may be referred to as open hole. While the wellsite environment 100 illustrates a land-based subterranean environment, the present disclosure contemplates any wellsite environment including a subsea environment. In one or more embodiments, any one or more components or elements may be used with subterranean operations equipment located on offshore platforms, drill ships, semi-submersibles, drilling barges, and land-based rigs.

In some embodiments, various types of hydrocarbons or fluids 112 may be pumped from wellbore 104 to the surface 102 via the production tubing 108 using an electric submersible pump (ESP) assembly 126 disposed or positioned downhole, for example, within, partially within, or outside casing string 106 of wellbore 104. The ESP assembly 126 can be located within the vertical portion 132, the deviated portion, the horizontal portion 138, or combination thereof, e.g., a transitional portion. The ESP assembly 126 may comprise various assemblies or sub-assemblies referred to as sections including a pump section 114, an intake section 116, a seal section 118, a motor section 120, and a sensor package 122. In some embodiments, the pump section 114 may comprise one or more centrifugal pump stages, each centrifugal pump stage comprising an impeller mechanically coupled to a drive shaft and a corresponding diffuser held stationary by and retained within the centrifugal pump assembly (e.g., retained by a housing of the centrifugal pump assembly). In some embodiments, the pump section 114 may not contain a centrifugal pump but instead may comprise a rod pump, a piston pump, a progressive cavity pump, or any other suitable pump system or combination thereof.

The pump section 114 may transfer pressure to the production fluid 112 or any other type of downhole fluid to pump or lift the fluid 112 from the downhole reservoir to the surface 102 at a desired or selected pumping rate. In one or more embodiments, fluid 112 may enter the wellbore 104, casing string 106 or both through one or more perforations 130 in the permeable formation 124 and flow uphole to the intake section 116 of the ESP assembly 126. In some embodiments, the intake section 116 includes at least one port or inlet 134 for the production fluid 112 within the wellbore 104 to enter into the ESP assembly 126. The intake section 116 can be fluidically connected to the annulus 128 for the transfer of production fluids 112 to the pump section 114. In some embodiments, the intake section 116 can be configured to intake a production fluid 112 with a mix of liquid and gas, separate the liquid portion, expel the gaseous portion, and transfer the liquid portion to the pump section 114. The centrifugal pump stages within the pump section 114 may transfer pressure to the fluid 112 by adding kinetic energy to the fluid 112 via centrifugal force and converting the kinetic energy to potential energy in the form of pressure. In one or more embodiments, pump section 114 lifts the pressurized fluid 140 to the surface 102. In some embodiments, the fluid 112 may be referred to as reservoir fluid.

In some embodiments, a motor section 120 can include a drive shaft and an electric motor. In some embodiments, an electric cable 136 can be coupled to the electric motor of the motor section 120 and to a controller at the surface 102. The electric cable 136 can provide power and communication to the electric motor, transmit one or more control or operation instructions from controller to the electric motor, or both. In some embodiments, the electric motor may be a two pole, three phase squirrel cage induction motor, a permanent magnet motor (PMM), a hybrid PMM (induction and PMM combined) or any other electric motor operable or configurable to provide rotational power.

In some embodiments, the rotational power of the motor section 120 can be transferred from the motor section 120 to the pump section 114 via a drive shaft. A drive shaft within the motor section 120 can rotationally couple to a drive shaft within the seal section 118. The drive shaft within the seal section 118 can rotationally couple to a drive shaft within the intake section 116. The drive shaft within the intake section can rotationally couple to the drive shaft within the pump section 114. The rotational power of the motor section 120 can be transferred to the pump section 114 via a plurality of drive shafts rotationally coupled together.

Figure 2:
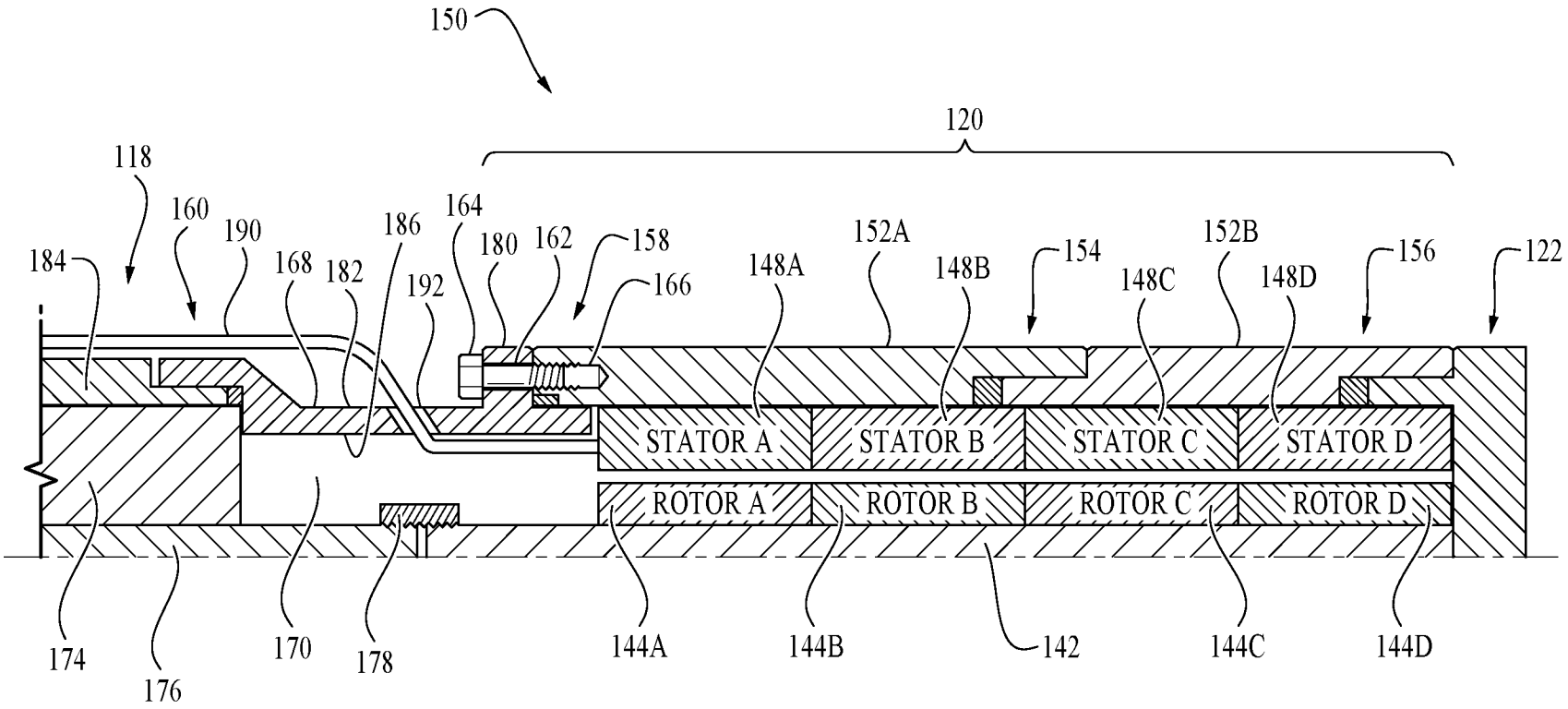
FIG. 2 is a partial cross-sectional view of a portion of the motor section according to an embodiment of the disclosure.

Turning now to FIG. 2, a lower portion 150 of the ESP assembly 126 is described. In some embodiments, a lower portion 150 comprises the seal section 118, the motor section 120, and the sensor package 122. In some embodiments, the motor section 120 can comprise a drive shaft 142, a rotor 144, a stator 148, and a housing 152. The rotor 144 can be mechanically coupled to the drive shaft 142. In some embodiments, the rotor 144 and drive shaft 142 can be a unitary construction. The stator 148 can be mechanically coupled to the housing 152. In some embodiments, the motor section 120 can comprise a first housing 152A and a second housing 152B. Although the motor section is illustrated with a first housing 152A and a second housing 152B, it is understood that the motor section 120 can comprise 1, 2, 3, 4, 5, 6, 7, 8, 9, 10, or any number of housings 152.

In some embodiments, a threaded connection 154 can mechanically couple the first housing 125A to the second housing 152B. The threaded connection 154 can be a low profile connection that comprises an external thread, an internal thread, and a graphite ring as will be disclosed hereinafter.

In some embodiments, a pinned connection 156 can mechanically couple the second housing 152B to the sensor package 122. The pinned connection 156 can comprise a housing, an end cap, a retaining pin, and a graphite ring as will be disclosed hereinafter. Although the pinned connection is described as coupling to the sensor package 122, it is understood that the pinned connection can be coupling to an end cap 122 that is a part of the motor section 120, a part of the sensor package 122, or any other section or assembly of the ESP assembly 126.

In some embodiments, a bolted joint 158 can mechanically couple the first housing 152A to a bottom flange 168 of the seal section 118. The bolted joint 158 can comprise a flange head 180 with at least one anchor port 162, at least one retainer bolt 164 threadingly coupled to an engagement port 166, a seal surface, and a graphite ring as will be disclosed hereinafter.

In some embodiments, an interference connection 160 can mechanically couple a housing 184 of the seal section 118 to the bottom flange 168. The interference connection 160 can comprise an outer retaining surface, an internal seal surface, and a graphite ring as will be disclosed hereinafter.

As illustrated in FIG. 2, the lower portion 150 can comprise a seal section 118 mechanically coupled to the motor section 120 by a bottom flange 168. The seal section 118 comprises a housing 184 mechanically coupled to the bottom flange 168 by the interference connection 160. The seal section 118 can comprise a drive shaft 176 and a seal mechanism 174 configured to form a rotational seal with the drive shaft 176. The seal mechanism 174 comprises a shaft seal, a bag seal, a labyrinth seal, or combinations thereof. The drive shaft 176 of the seal section 118 can be rotationally coupled to the drive shaft 142 of the motor section 120 by a shaft coupling In some embodiments, the bottom flange 168 of the seal section 118 comprises a generally cylinder shape with an outer surface 182, an inner surface 186, and the flange head 180. A fluid chamber 170 can be formed between the inner surface 186 of the bottom flange 168, the sealing mechanism 174, the drive shaft 176 of the seal section, the drive shaft 142 of the motor section 120. The fluid chamber 170 can transfer cooling fluid from the motor section 120 to the seal section 118.

In some embodiments, a motor lead 190 can pass through a pothead connector 192 sealingly coupled by a graphite ring in a sealing configuration to the bottom flange 168 to electrically couple with the stators 148. The motor lead 190 comprises three phases, also referred to as leads, that couple with the stators of the three phase electric motor of the motor section 120. The pothead connector 192 can form a seal with the graphite seal in a sealing configuration to the motor lead 190 to prevent the ingress of wellbore fluids via the port in the bottom flange 168. Although only a motor lead 190 is illustrated, it is understood that the motor section 120 typically comprises multiple leads and splices installed during the assembly of the ESP assembly 126. For example, the electric cable 136 from FIG. 1 can be electrically coupled to the motor lead 190 by an external splice and the motor lead 190 can be electrically coupled to a stator lead by an internal splice. Thus, the electric cable 136, also referred to as a power cable, can be electrically coupled to the stators 148 of the motor section 120 via various leads and splices.

Although the motor section 120 is illustrated with four rotors 144A-D, it is understood that the motor section can comprise 1, 2, 3, 4, 5, 6, 7, 8, 9, 10, or any number of rotors 144. Although the motor section 120 is illustrated with four stators 148A-D, it is understood that the motor section 120 can comprise 1, 2, 3, 4, 5, 6, 7, 8, 9, 10, or any number of stators 148. Although the motor section 120 is illustrated with four rotors 144 and four stators 148, the motor section 120 can comprise an unequal number of rotors 144 and stators 148. For example, the motor section can comprise one rotor 144 with four stators 148A-D. In some context, two or more stators 148A-D can be referred to as stator modules and the compete assembly of stator modules can be referred to as a stator 148.

In some embodiments, the motor section 120 can comprise two or more drive shafts 142 mechanically coupled together. For example, the first rotor 144A can be coupled to a first drive shaft 142A, the second rotor 144B can be coupled to a second drive shaft 142B, the third rotor 144C can be coupled to a third drive shaft 142C, and the fourth rotor 144D can be coupled to a fourth drive shaft 142D. The first drive shaft 142A can be coupled to the second drive shaft 142B, and the second drive shaft 142B can be coupled to the third drive shaft 142C. In some embodiments, the motor section 120 may comprise two or more electric motors coupled together.

In some embodiments, each rotor 144 comprises a core and an induction squirrel cage that comprises conductors parallel to the center axis of the drive shaft 142, a first end ring electrically connected to a first set of ends of the conductors, and a second end ring electrically connected to a second set of ends of the conductors. A motor within the motor section 120 with these types of rotors 144 may be referred to as a conventional induction electric motor.

In some embodiments, each rotor 144 comprises a core and permanent magnet elements. The core may be formed from a plurality of metal laminations defining apertures to receive the conductors or the permanent magnet elements. The laminations may be made of magnetic metal. The laminations may be coated with an insulating material to reduce eddy currents between laminations of the rotor core. In an embodiment, the rotor core may be a solid core of magnetic metal. A motor within the motor section 120 with these types of rotors 144 may be referred to as a PMM electric motor.

In an embodiment, each rotor 144 may be a hybrid rotor and may comprise a core, an induction squirrel cage, and permanent magnet elements. A motor within the motor section 120 with these types of rotors 144 may be referred to as a hybrid PMM electric motor.

Figure 3A:
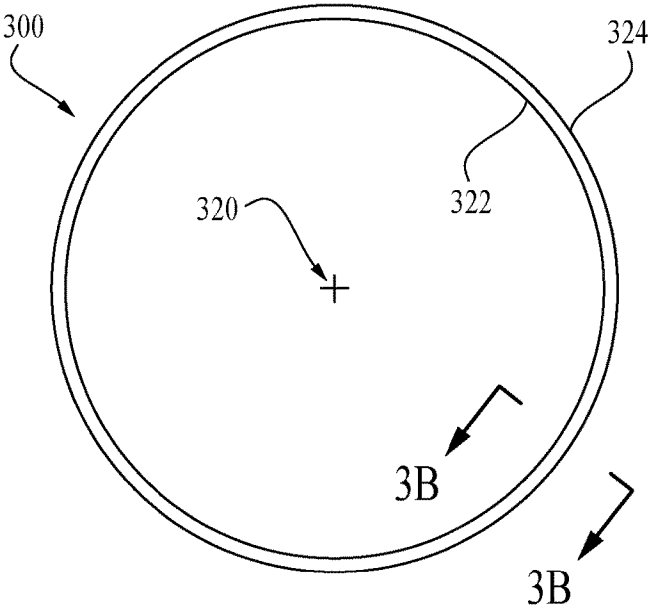
FIG. 3A is a front view of a graphite seal ring according to an embodiment of the disclosure.
Figure 3B:
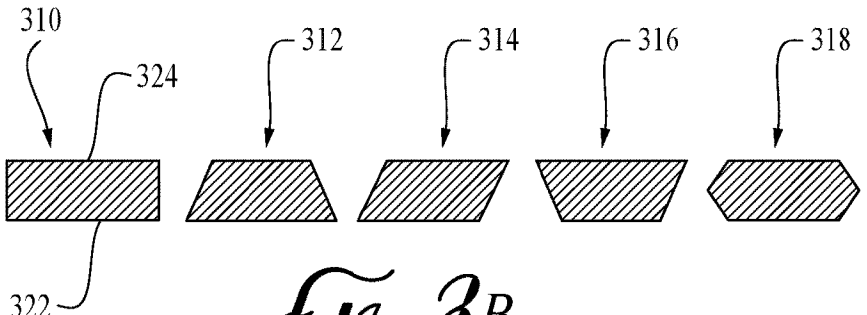
FIG. 3B is a sectional view of the graphite seal with various cross-sectional shapes according to an embodiment of the disclosure.

Turning now to FIGS. 3A and 3B, a graphite seal 300 configured to form a seal within a connection of an ESP assembly 126 is described. In embodiments, the graphite seal 300 can be an embodiment of the seal described in the threaded connection 154, the pinned connection 156, the bolted joint 158, and the interference connection 160.

The graphite seal 300 is a pressed ring manufactured from graphite. The graphite material the graphite seal 300 can be made from isostatically pressed graphite of typically better than 98% to 99.85% purity without binders or fillers. This type seal, e.g., graphite seal 300, made from pressed graphite is commercially available, for example, "GeeGraf Die Formed Rings" from Gee Graphite Limited.

As shown in FIGS. 3A and 3B, the graphite seal 300 can be a generally ring shape with an inner surface 322 and an outer surface 324 revolved about a central axis 320 with a quadrilateral shape cross-section 310. The quadrilateral shape comprises four sides and four corners. The first quadrilateral shape can be a rectangular shape 310. The long side of the rectangular shape 310 can be parallel to the central axis 320 of the graphite seal 300. The graphite seal 300 may have other quadrilateral shapes with alternate cross-sectional shapes, for example, trapezoidal shapes. For example, an isosceles shape 312 can have the two equal length short sides that form an acute angle towards the central axis 320 of the graphite seal 300. The parallelogram shape 314 can have four parallel sides with the long sides parallel to the central axis 320 of the graphite seal 300. In another example, an inverted isosceles shape 316 can have the two equal in length short sides form an obtuse angle towards the central axis 320 of the graphite seal 300. In still another example, an elongated hexagon shape 318 can have the four parallel short sides equal in length and two long sides that are parallel with the central axis 320 of the graphite seal 300. Although five shapes are illustrated, any number of geometric shapes with planar sides can be utilized, for example, a square shape. Although the graphite seal 300 is described as a generally ring shape, it is understood that the cross-sectional shape, e.g., rectangular shape 310, can be revolved about any shape, for example, rectangular seal shape 340 of FIG. 3D.

Figure 3C:
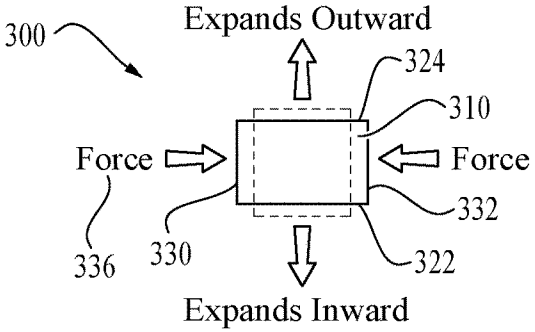
FIG. 3C is a sectional view of the graphite seal with an actuation force applied according to an embodiment of the disclosure.
Figure 3D:
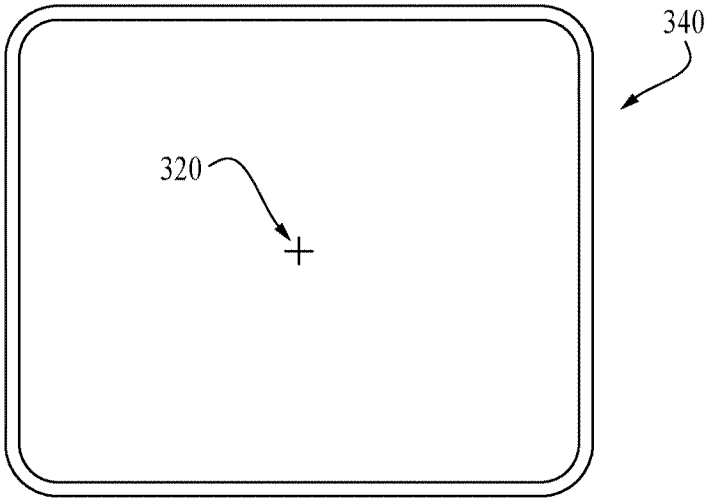
FIG. 3D is a front view of a graphite seal ring according to another embodiment of the disclosure.

The graphite seal 300 can be energized into a sealing configuration by applying force parallel to the central axis 320. Turning now to FIG. 3C, the sealing configuration of the sealing configuration of the graphite seal 300 is described. The graphite seal 300 can be installed over an external seal surface (not shown) of a component of the motor section 120, e.g., an end cap. The graphite seal 300 can have a slip fit or allowance fit between the external seal surface and the inner surface 322 of the graphite seal 300. A mating part, e.g., a housing, with an internal seal surface (not shown) can be installed over the graphite seal 300. The graphite seal 300 can have a slip fit or allowance fit between the internal seal surface and the outer surface 324 of the graphite seal 300. The graphite seal 300 can be transformed from an installation configuration into a sealing configuration by applying an axial load to the end faces 330, 332. During the transformation process, an axial load, e.g., force 336, applied in one direction has a resultant force in the opposite direction, thus the axial load, e.g., force 336, creates a pressure in the axial direction with the force 336 applied across the cross-sectional area of the end face 330 and the resultant force acting on the opposite face, e.g., end face 332. The pressure in the axial direction (from force 336) can translate into a pressure in the radial directions. With the graphite material, this effect is governed by Hooke's Law, that determines the strains (ratio of change in length of part to the length of the part) based on the input stresses to the part (force per unit area on a face, e.g. pressure) in the three orthogonal directions x, y and z, with the constant of proportionality being the Poisson's ratio. Using this basic set of engineering equations (or a FEA analysis), a transformational loading and strains can be determined to show that a pressure in the axial direction (e.g. due to a change in length from compression) does cause a pressure in the radial direction to transform the graphite seal 300 from the installation configuration to the sealing configuration. For example, the axial load, e.g. force 336, applied to end face 330 can radially expand the inner surface 322 into sealing condition with the external seal surface and radially expand the outer surface 324 into sealing configuration with the internal seal surface as will be described hereinafter.

Figure 4A:
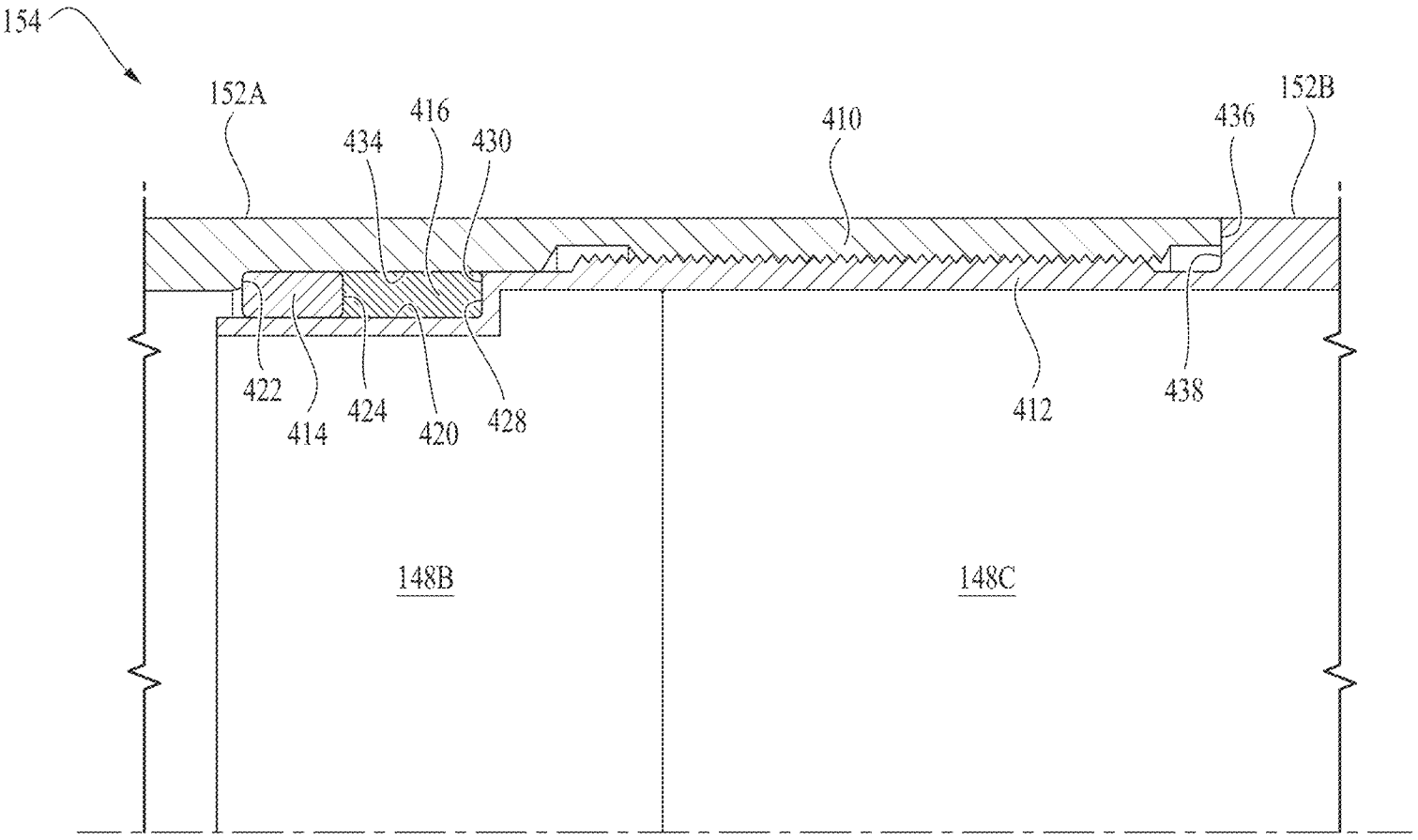
FIG. 4A is a partial cross-sectional view of a graphite seal located in a threaded connection according to an embodiment of the disclosure.

Turning now to FIG. 4A, a partial cross-sectional view of threaded connection 154 can be described. In some embodiments, the threaded connection 154 can be a low profile connection that forms a seal between three components, e.g., a first housing 152A, a second housing 152B, and an internal component. The low profile connection, e.g., threaded connection 154, comprises an internal thread 410, an external thread 412, a spacer ring 414, and a graphite ring 416. The threaded connection 154 can couple a first component with an external seal surface, e.g., stator 148, a second component with an internal seal surface, e.g., first housing 152A, and a third component, e.g., a second housing 152B. It is understood that the location of the threaded connection 154 is exemplary and thus, the threaded connection 154 can be located over any one or more stators 148 and/or anywhere within the ESP assembly 126. The graphite ring 416 can be an embodiment of graphite seal 300 with rectangular shape 310. The graphite ring 416 and spacer ring 414 can be installed onto an external seal surface 420 of the first component, e.g., stator 148. As previously described, the graphite ring 416 and spacer ring 414 can have an allowance or sliding fit with the external seal surface 420 in the installation configuration. The graphite ring 416 can be transformed into a sealing configuration during the make-up or coupling of the internal thread 410 to the external thread 412. For example, during the make-up of the internal thread 410 of the housing 152A onto the external thread 412 of the housing 152B, an internal shoulder 422 contacts the spacer ring 414 to apply axial force to the graphite ring 416 located between the front face 424 of the spacer ring 414 and the back face 428 of the stator 148 and in some embodiments, the end face 430 of the external thread 412. The axial force applied by the make-up of the threads applies a pressure across the front face 424 of the spacer ring 414 to the graphite ring 416. The applied pressure can transform the graphite ring 416 from the installed configuration to the sealing configuration wherein the inner surface, e.g., inner surface 322, of the graphite ring 416 forms a seal with the external seal surface 420 of the stator 148, the outer surface, e.g., outer surface 324, forms a seal with an internal seal surface 434 of the internal thread 410, the end face 332 forms a seal with the end face 430 of the second housing 152B, and the end face 332 forms a seal with the back face 428 of the stator 148B. The amount of force applied by the make-up of the threads can be determined by the axial displacement of the front face 424 of the spacer ring 414 towards the back face 428 of the stator 148 and controlled by the front face 436 of the internal thread 410 contacting the end face 438 of the external thread 412. Likewise, the amount of force applied by the make-up of the threads can be controlled or determined by the location of the shoulder 422, the axial length of the spacer ring 414, the axial length of the graphite ring 416, or any combination thereof. The axial displacement of the threads, e.g., internal thread 410 to external thread 412, can reconfigure a graphite ring 416 from an installation configuration to a sealing configuration.

In some embodiments, the threaded connection 154 can be a standard profile connection configured to seal between two components, e.g., the first housing 152A and the second housing 152B. In the standard profile connection, the external sealing surface 420 can be a portion of the second housing 152B. For example, the second housing can be thicker in the radial direction to include the end face 430 and the external seal surface 420. In this scenario, the graphite ring 416 can form a seal in the sealing configuration between two components at the internal seal surface 434 of the first housing 152A and the external seal surface 420 of the second housing 152B. In some embodiments, the graphite ring 416 can form a seal in the sealing configuration along the end face 430 of the second housing 152B.

Figure 4B:
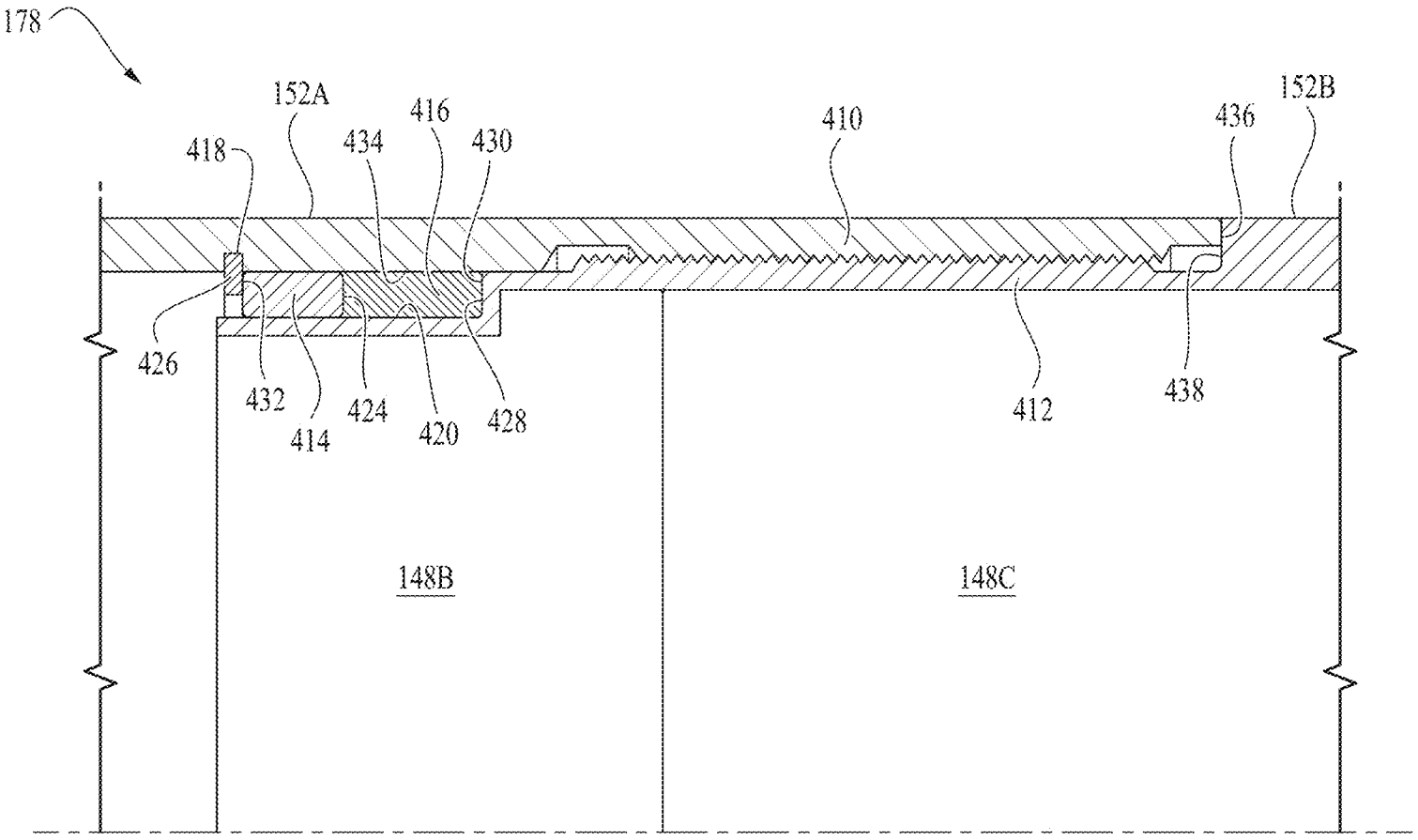
FIG. 4B is a partial cross-sectional view of a graphite seal located in a threaded connection according to another embodiment of the disclosure.

Turning now to FIG. 4B, a partial cross-sectional view of an alternative embodiment of the threaded connection 154 can be described. In some embodiments, the threaded connection 178 comprises an internal thread 410, an external thread 412, a retaining ring 426, a spacer ring 414, and a graphite ring 416. The housing 152A can have an alternative structure comprising an internal circumferential groove, e.g., internal groove 418, located proximate to the internal seal surface 434 and/or the internal thread 410. A retaining ring 426 can be installed into the internal groove 418. A front face 432 of the retaining ring 426 can contact or abut a complementary face of the spacer ring 414. The graphite ring 416 can be transformed to the sealing configuration by the force generated by the axial displacement of the front face 424 of the spacer ring 414 towards the back face 428 of the stator 148. The axial location of the internal groove 418, the length of the spacer ring 414, and the make-up of the threaded connection can determine the amount of axial force applied to the graphite ring 416. The retaining ring 426 can be any type of partial ring shape installable into a circumferential groove to establish a protrusion, shoulder, or feature, within a cylindrical housing. Examples of retaining rings include an arc shape ring of less than 360 degrees, an arc shape ring of greater than 360 degrees, and a wave shape arch shape spring ring of greater than 360 degrees.

In some embodiments, the graphite ring 416 can be transformed from the installation configuration to the sealing configuration after the threaded connection has be made-up. For example, the external thread 412 can be installed or make-up onto the internal thread 410 until the end face 436 contacts the shoulder 438. The graphite ring 416 and spacer ring 414 can be placed inside the housing 152 or other ESP component from the end opposite the internal thread 410. The graphite ring 416 and spacer ring 414 can be installed between internal seal surface 434 and external seal surface 420 so that the graphite ring 416 abuts the back face 428. The retainer ring 426 can be slid into the inside of the housing to abut the spacer ring 414. A suitable installation tool can apply an axial force to transform the graphite ring from the installation configuration to the sealing configuration as the front face 424 moves axially towards the back face 428 until the retaining ring 426 aligns with the groove 418 and snaps or installs into the groove 418.

Figure 5:
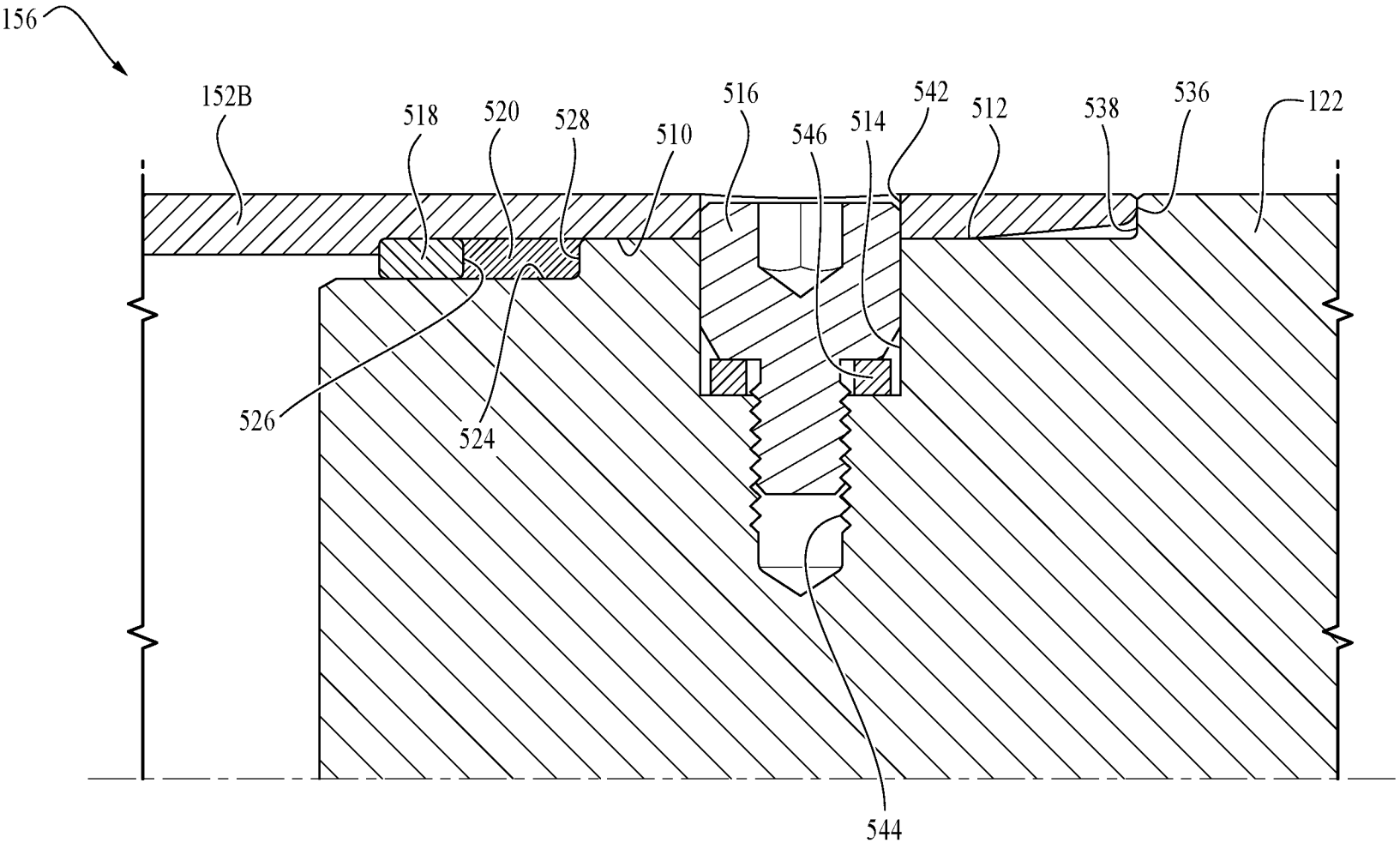
FIG. 5 is a partial cross-sectional view of a graphite seal located in a pinned connection according to an embodiment of the disclosure.

Turning now to FIG. 5, a partial cross-sectional view of pinned connection 156 can be described. In some embodiments, the pinned connection 156 comprises an external receiving surface 512 on a first component, an internal seal surface 510 on a second component, a retaining port 514, a retaining bolt 516 with locking ring/washer 546, a spacer ring 518, and a graphite ring 520. The pinned connection 156 can couple a first component, e.g., an end cap 122, and a second component, e.g., a second housing 152B. It is understood that the location of the pinned connection 156 is exemplary and thus, the pinned connection 156 can be located anywhere within the motor section 120 and/or anywhere within the ESP assembly 126. The graphite ring 520 can be an embodiment of graphite seal 300 with rectangular shape 310. The graphite ring 520 and spacer ring 518 can be installed onto an external seal surface 524 of the first component, e.g., end cap 122. As previously described, the graphite ring 520 and spacer ring 518 can have an allowance or sliding fit with the external seal surface 524 in the installation configuration. The graphite ring 520 can be transformed into a sealing configuration during the assembly of the end cap 122 to the housing 152B by force applied during the assembly process. For example, during the assembly process an external loading mechanism (e.g., a press, a tie-rod, etc.) can apply an axial force (e.g., pull or push) to bring the pinned connection 156 together and apply the axial force to the graphite ring 520. The housing 152B can be partially installed over the external receiving surface 512 of the end cap. The external loading mechanism can apply an axial force that is transferred to an internal shoulder within the housing 152B that contacts the spacer ring 518 to apply axial force to the graphite ring 520 located between the front face 526 of the spacer ring 518 and the back face 528 of the end cap 122. The axial force applied by the external loading mechanism applies a pressure across the front face 526 of the spacer ring 518 to the graphite ring 520. The applied pressure can transform the graphite ring 520 from the installed configuration to the sealing configuration wherein the inner surface, e.g., inner surface 322, of the graphite ring 520 forms a seal with the external seal surface 524 of the end cap 122 and the outer surface, e.g., outer surface 324, forms a seal with an internal seal surface 510 of the housing 152B. The amount of force applied by the external loading machine can be determined by the axial displacement of the front face 526 of the spacer ring 518 towards the back face 528 of the end cap 122 and controlled by the front face 536 of the housing 152B contacting the end surface 538 of the external receiving surface 512. A retaining bolt 516 can installed through a housing port 542 on the housing 152B and a retaining port 514 in the end cap 122. The retaining bolt 516 can threadingly engage an retainer feature 544 and in some embodiments, a locking ring/washer 546 can apply additional tension to secure the retaining bolt 516. The axial displacement of the front face 536 of the housing 152B to contact the end surface 538 of external receiving surface 512 can reconfigure a graphite ring 520 from an installation configuration to a sealing configuration. Although a retaining bolt 516 is described, it is understood that any type of fastener can be installed through the housing 152 and end cap 122, for example, a machine screw, a tapered screw, a headless screw, a pin, a grooved pin, a roll pin, or any other suitable mechanical fastener.

Figure 6:
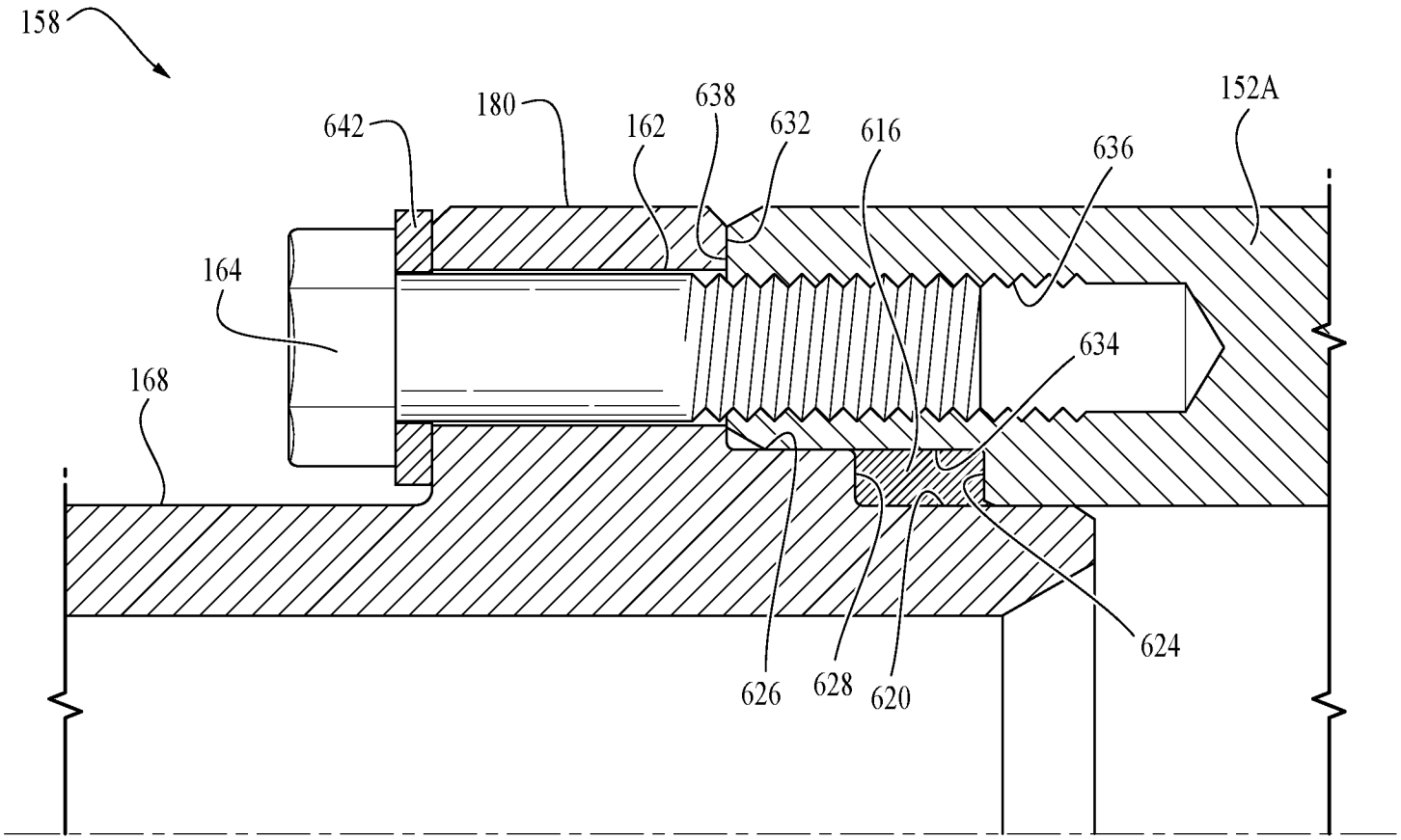
FIG. 6 is a partial cross-sectional view of a graphite seal located in a bolted connection according to an embodiment of the disclosure.

Turning now to FIG. 6, a partial cross-sectional view of a bolted joint 158 can be described. In some embodiments, the bolted joint 158 comprises a flange head 180, an external seal surface 620 on a first component, an internal seal surface 634 on a second component, an anchor port 162, a retainer bolt 164, and a graphite ring 616. The bolted joint 158 can couple a first component, e.g., a bottom flange 168, and a second component, e.g., a first housing 152A. It is understood that the location of the bolted joint 158 is exemplary and thus, the bolted joint 158 can be located anywhere within the motor section 120 and/or anywhere within the ESP assembly 126. The graphite ring 616 can be an embodiment of graphite seal 300 with rectangular shape 310 of FIG. 3. The graphite ring 616 can be installed onto an external seal surface 620 of the first component, e.g., bottom flange 168. As previously described, the graphite ring 616 can have an allowance or sliding fit with the external seal surface 620 in the installation configuration. The graphite ring 616 can be transformed into a sealing configuration during the assembly of the first component, e.g., bottom flange 168, to the second component, e.g., housing 152A, by a force applied during the assembly process of tightening the retainer bolts 164. For example, during the assembly process a plurality of retainer bolts 164 can be tightened in a predetermined sequence to apply an axial force (e.g., tensile load) to bring the bolted joint 158 together and apply the axial force to the graphite ring 616. During the assembly process, the housing 152A can be partially installed over the external receiving surface 626 of the bottom flange 168. The retainer bolts 164 can be installed though the anchor ports 162 on the flange head 180 and partially threaded into the threaded ports 636 of the housing 152A. The bolts can be slowly tightened in a predetermined sequence to apply an axial force that is transferred to the front face 624 within the housing 152A to apply axial force to the graphite ring 616 located between the front face 624 and the back face 628 of the bottom flange 168. The axial force applied by the sequential tightening of the retainer bolts 164 applies a pressure across the front face 624 of the housing 152A to the graphite ring 616. The applied pressure can transform the graphite ring 616 from the installed configuration to the sealing configuration wherein the inner surface, e.g., inner surface 322, of the graphite ring 616 forms a seal with the external seal surface 620 of the bottom flange 168 and the outer surface, e.g., outer surface 324, forms a seal with an internal seal surface 634 of the housing 152A. The amount of force applied by the retainer bolts 164 can be determined by the axial displacement of the front face 624 towards the back face 628 of the bottom flange 168 and controlled by the flange face 632 of the flange head 180 contacting the end face 638 of the housing 152A. The retainer bolt 164 can threadingly engage a threaded port 636 of the housing 152A and in some embodiments, a locking ring 642 or other type of fastener can apply additional tension to secure the retainer bolt 164. The axial displacement of the flange face 632 of the flange head 180 to contact the end face 638 of the housing 152A can reconfigure a graphite ring 616 from an installation configuration to a sealing configuration. Although a retainer bolt 164 is described, it is understood that any type of fastener may be utilized, for example, a nut and bolt, a locking nut and bolt, a threaded port and bolt, a threaded stud with two nuts, or any suitable mechanical coupling device.

Figure 7C:
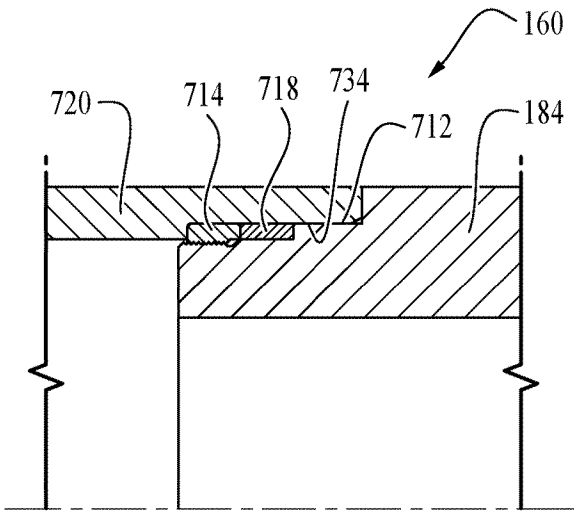
FIG. 7A-C is a partial cross-sectional view of a graphite seal located in an interference connection according to an embodiment of the disclosure.
Figure 7A:
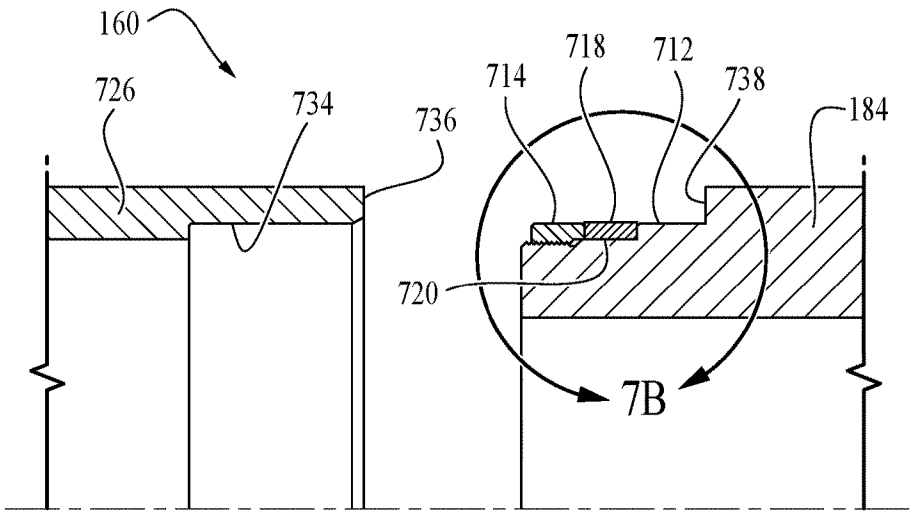
Figure 7B:
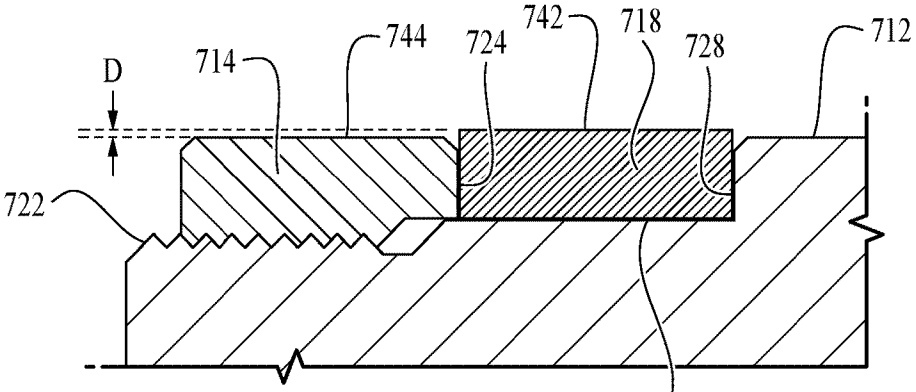

Turning now to FIG. 7A-C, a partial cross-sectional view of the interference connection 160 can be described. In some embodiments, the interference connection 160 comprises an external receiving surface 712 on a first component, an internal seal surface 710 on a second component, a seal end ring 714, and a graphite ring 718. The interference connection 160 can couple a first component, e.g., a seal section housing 184, to a second component, e.g., a flange boss 726 of the bottom flange 168. It is understood that the location of the interference connection 160 is exemplary and thus, the interference connection 160 can be located anywhere within the seal section 118, the motor section 120, and/or anywhere within the ESP assembly 126. The graphite ring 718 can be an embodiment of graphite seal 300 with rectangular shape 310. The graphite ring 718 can be installed onto an external seal surface 720 of a first component, e.g., a housing 184, to abut a back face 728 of the housing 184. In some embodiments, the graphite ring 718 can have an allowance or sliding fit with the external seal surface 720 of the first component in the installation configuration. In some embodiments, the graphite ring 718 can have an interference fit and can be heated to an elevated temperature to thermally expand the inner surface of the graphite ring 718 to provide an allowance fit over the external seal surface 720 of the first component. As shown in FIG. 7B, the outer surface 742 of the graphite ring 718 can be a radial distance "D" greater than the outer surface 744 of the seal end ring 714 after the interference fit. A retaining ring can be threadingly coupled to an external thread 722 on the housing 184 to abut the graphite ring 718. In some embodiments, the seal end ring 714 can be replaced with a spacer ring, e.g., spacer ring 518, and a retaining ring, e.g., retaining ring 426, installed into an outer groove (not shown) proximate to the external seal surface 720.

In some embodiments, the graphite ring 718 can be expanded by the seal end ring 714. The seal end ring 714 can be threadingly coupled to place the front face 724 of the seal end ring 714 a predetermined distance from the back face 728 of the housing 184 to apply an axial force to the graphite ring 718. The application of force can expand the graphite ring 416 until the outer surface 742 of the graphite ring 416 is a radial distance "D" above the outer surface 744 of the seal end ring 714. In some embodiments, the seal end ring 714 and the external thread 722 on the housing 184 can be replaced with a spacer ring, e.g., spacer ring 414, and an retainer ring, e.g., retainer ring 426, installed into an external groove.

After the outer surface 742 of the graphite ring is expanded, the second component, e.g., flange boss 726, can be installed with an interference fit onto the first component, e.g., housing 184. In some embodiments, internal seal surface 734 and the flange boss 726 can be thermally expanded, the external seal surface 720 can be thermally contracted, or both. For example, a heat source can apply heat at an elevated temperature to expand the internal seal surface 734 of the flange boss 726. In another scenario, a cold source, e.g., liquid nitrogen, can apply cold at a reduced temperature to contract the external seal surface 720, the graphite ring 718, and the housing 184. After application of the heat and/or cold, the internal seal surface 734 can have an allowance fit with the outer surface 742 of the graphite ring 718. As shown in FIG. 7C, the internal seal surface 734 of the flange boss 726 can be installed over the external receiving surface 712 and graphite ring 718 until the front face 736 of the flange boss 726 abuts the end face 738 of the housing 184. After the flange boss 726 cools from the elevated temperature and/or the housing 184 warms from the cold temperature, the graphite ring 718 can be transformed to a sealing configuration and the internal seal surface 734 of the flange boss 726 can have an interference fit with the external receiving surface 712.

An ESP assembly 126 using the graphite seals 300 can be utilized for producing wellbore fluids to the surface. In some embodiments, a method of lifting a production fluid in a wellbore to surface can be performed by operating an electric motor within a motor section 120, as described above, having a graphite seal, e.g., threaded connection 154 of FIG. 4, pinned connection 156 of FIG. 5, bolted joint 158 of FIG. 6, or interference connection 160 of FIG. 7. The ESP assembly, e.g., ESP assembly 126, can be transported to a remote wellsite. The ESP assembly comprises a pump section, e.g., pump section 114, a seal section, e.g., seal section 118, and a motor section, e.g., motor section 120. The electric motor comprises a drive shaft, at least one rotor, at least one stator, and a housing.

Coupling the ESP assembly to a production tubing, e.g., production tubing 108. Electrically coupling the motor section of the ESP assembly to a controller at surface via an electric cable 136. Conveying the ESP assembly into the wellbore 104 via the production tubing.

Providing electric power to the electric motor of the motor section of the ESP assembly via the power cable. Lifting production fluid by the ESP assembly while located in a downhole environment having a temperature in the range from 25 degrees Celsius to 100 degrees Celsius, from 100 degrees Celsius to 150 degrees Celsius, from 150 degrees Celsius to 200 degrees Celsius, from 200 degrees Celsius to 280 degrees Celsius, or from 280 degrees Celsius to 350 degrees Celsius.

Lifting production fluid by the ESP assembly while located in a downhole environment having a temperature in the range from 280 degrees Celsius to 350 degrees Celsius. In an embodiment, the lifting of production fluids by the ESP assembly while located in a downhole environment can include a temperature range of 280 degrees Celsius to 400 degrees Celsius, a range of 280 degrees Celsius to 450 degrees Celsius, a range of 280 degrees Celsius to 500 degrees Celsius, or a range of 280 degrees Celsius to 550 degrees Celsius. In an embodiment, a high temperature limitation for operation of the ESP assembly may be established not by the graphite rings but instead by other components in the electric motor such as the dielectric oil in the electric motor.

The downhole environment may have a high temperature continuously or the temperature may reach into the high temperature range under certain infrequent but notwithstanding predictable circumstances. For example, in a SAGD downhole environment, temperature may remain in a first temperature range during normal operations, but when steam undesirably breaks into the main production wellbore (e.g., passes from the steam bearing wellbore parallel into the production wellbore), the downhole temperature may enter into a second higher temperature range. While steam breaking into the main production wellbore (e.g., into wellbore 104 of FIG. 1) may be infrequent, it can be expected to happen from time to time, and it may be desirable under this eventuality that the electric motor within the motor section 120 be able to survive and operate in this circumstance. In a geothermal production environment, the downhole temperature may remain continuously in a high temperature range.

While the description of the method above has been articulated with reference to an electric motor, it will be appreciated that that method is easily adapted to a method of lifting production fluid in a wellbore by operating a seal section of an ESP assembly having graphite rings sealing within coupled joints, by operating a gas separator of an ESP assembly having graphite rings sealing within coupled joints, by operating a pump assembly having graphite rings sealing within coupled joints, by operating an electric motor having graphite rings sealing within coupled joints, and/or by operating an electric motor having graphite rings sealing one or more electrical connectors.

In some embodiments, the ESP assembly 126 can be reconfigured for use within a geothermal source. For example, the ESP assembly 126 can lift water at an elevated temperature from a geothermal source, e.g., geothermal wells. The downhole environment of a geothermal source may have a continuous high temperature and it may be desirable that each section within the ESP assembly 126 be able to survive and operate in this environment, for example, the electric motor within the motor section 120. The graphite ring, e.g., graphite ring 300, in the sealing configuration can prevent the ingress of wellbore fluids into each section of the ESP assembly.

In some embodiments, the ESP assembly 126 can be reconfigured for use at the surface. For example, the ESP assembly 126 can be reconfigured as a production pump assembly located at surface 102. For example, the ESP assembly 126 can be reconfigured as a horizontal surface pump assembly configured to pump fluid from the production tubing 108 or into the production tubing 108 via a wellhead 146. The horizontal surface pump assembly can be fluidically connected to the production tubing 108 via a wellhead 146, a production tree, or any suitable pressure isolation devices. The horizontal surface pump assembly can be located at surface 102 and configured to pump fluid, e.g., salt water, from a volume, e.g., pipeline or storage tank, into the production tubing 108 via the wellhead 146. In another scenario, the horizontal surface pump assembly can transfer, also referred to as boosting, fluid 112 from the production tubing 108 to another surface facility. The horizontal surface pump configuration (e.g., reconfiguration of the ESP assembly 126) may comprise at least one pump section 114, an intake section 116, a seal section 118 (also called a thrust chamber), and motor section 120. Although the horizontal surface pump configuration may have a different appearance than the downhole configuration of the ESP assembly 126, it is understood that the general description and function of the sections are the same. The horizontal surface pump reconfiguration of ESP assembly 126 may be mounted on a skid or installed within a surface facility.

Additional Disclosure

The following are non-limiting, specific embodiments in accordance and with the present disclosure:

A first embodiment, which is a seal mechanism for an electric submersible pump (ESP) assembly disposed in a wellbore extending from an earth surface and penetrating a subterranean formation, comprising a graphite ring with a geometric (e.g., rectangular) cross-section revolved about a central axis (e.g., a central axis of the ESP assembly as shown in FIG. 3A); wherein the graphite ring has an installation configuration and a sealing configuration; wherein the graphite ring is installed between an external sealing surface of a first component and an internal sealing surface of a second component; wherein an activation force transitions the graphite ring from the installation configuration to the sealing configuration; and wherein the graphite ring forms a seal to the external sealing surface and the internal sealing surface in the sealing configuration.

A second embodiment, which is the seal mechanism of the first embodiment, wherein the graphite ring is made from at least 98% pure graphite with no fillers.

A third embodiment, which is the seal mechanism of any of the first and the second embodiments, wherein the geometric cross-section comprises a square shape or an elongated shape comprising a quadrilateral shape or an hexagonal shape. In an aspect, the long side of the elongated shape is parallel to the central axis. In an aspect, the quadrilateral shape is i) a rectangular shape, ii) an isosceles shape, iii) a parallelogram shape, or iv) an inverted isosceles.

A fourth embodiment, which is the seal mechanism of any of the first through the third embodiments, wherein the graphite ring forms a seal within a threaded connection; wherein the first component with the external sealing surface is inside a section of the ESP assembly; wherein the second component with the internal sealing surface has an internal thread; and wherein a third component has an external thread.

A fifth embodiment, which is the seal mechanism of any of the first through the fourth embodiments, wherein the activation force is an axial force that is a result of the internal thread threading onto the external thread; wherein the activation force is applied through a spacer ring into the graphite ring; and wherein the threaded connection retains the activation force within the threaded connection A sixth embodiment, which is the seal mechanism of the first through the fifth embodiments, wherein the graphite ring forms a seal within a pinned connection; wherein the first component with the external sealing surface has a receiving port; and wherein the second component with the internal sealing surface has a housing port.

A seventh embodiment, which is the seal mechanism of any of the first through the sixth embodiments, wherein the activation force is an axial force that is applied by an external fixture to the first component and the second component; wherein the activation force is applied through a spacer ring into the graphite ring; and wherein a retaining bolt installed through the housing port and into the receiving port retains the activation force within the pinned connection.

An eighth embodiment, which is the seal mechanism of any of the first through the seventh embodiments, wherein the graphite ring forms a seal within a bolted joint; wherein the first component with the external sealing surface has a plurality of ports through a flange boss; and wherein the second component with the internal sealing surface has a plurality of threaded ports.

A ninth embodiment, which is the seal mechanism of any of the first through the eighth embodiments, wherein the activation force is an axial force that is applied by a plurality of retainer bolts installed through the plurality of ports in the flange boss and into the corresponding threaded ports in the second component; wherein the activation force is applied into the graphite ring from a front face and a back face; and wherein the plurality of retainer bolts retains the activation force within the bolted joint.

A tenth embodiment, which is the seal mechanism of any of the first through the ninth embodiments, wherein the graphite ring forms a seal within an interference connection; wherein the graphite ring is installed on the first component with the external sealing surface, an external receiving surface, and a retaining ring; wherein the end seal ring is threaded on the first component to i) abut the graphite ring or ii) compress the graphite ring; and wherein i) the second component with the internal sealing surface is expanded to an allowance fit over the graphite ring in the installation configuration by applied heat, ii) an external sealing surface and graphite ring is contracted to allowance fit with the internal sealing surface, or iii) both.

An eleventh embodiment, which is the seal mechanism of any of the first through the tenth embodiments, wherein the second component is axially positioned with the first component to align the internal seal surface over the graphite ring and the external receiving surface and activation force is an radial force that is applied by i) a thermally cooling the second component, ii) a thermally warming the first component, or both; wherein the activation force is applied into the graphite ring from an outer surface that is greater in diameter than the retaining ring by a radial distance "D"; and wherein an interference fit between the thermally cooled second component onto the external receiving surface of the first component retains the activation force within the interference connection.

A twelfth embodiment, which is the seal mechanism of any of the first through the ninth embodiments, wherein the ESP assembly comprises a pump section, an intake section, a seal section, a motor section, a sensor package, or any combination thereof.

A thirteenth embodiment, which is the bearing assembly of any of the first through the twelfth embodiments, wherein the first component, the second component, and the graphite ring are located within one or more sections of the ESP assembly.

A fourteenth embodiment, which a method forming a seal within an Electric Submersible Pump (ESP) assembly, comprising installing a graphite ring onto an external seal surface of a first component of the ESP assembly, and wherein the graphite ring is in an installation configuration; positioning a second component to align an internal seal surface of the second component with the graphite ring; applying an activation force to the graphite ring; and transforming the graphite ring from the installation configuration to a sealing configuration in response to applying the activation force, and wherein the graphite ring forms a seal to the external seal surface and the internal seal surface in the sealing configuration.

A fifteenth embodiment, which is the method of the fourteenth embodiment, further comprising retaining the graphite ring in the sealing configuration via a retaining mechanism.

A sixteenth embodiment, which is the method of the fourteenth or the fifteenth embodiment, wherein the retaining mechanism is selected from a group comprising i) a threaded connection, ii) a pinned connection, iii) a bolted connection, and iv) an interference connection.

A seventeenth embodiment, which is the method of any of the fourteenth through the sixteenth embodiments, wherein the activation force is provided by i) threadingly coupling the first component to the second component, ii) an external fixture, iii) a plurality of retaining bolts threadingly coupling the first component to the second component via anchoring ports, or iv) thermally cooling the second component from an elevated temperature to generate an interference fit, thermally warming the first component from a reduced temperature to generate an interference fit, or both.

An eighteenth embodiment, which is the method of any of the fourteenth through the sixteenth embodiments, comprising transporting an ESP assembly to a remote wellsite; coupling the ESP assembly to a production tubing; electrically coupling an electric motor of the ESP assembly to a controller via a power cable; conveying the ESP assembly, via the production tubing, into a wellbore penetrating a subterranean formation; controlling the electric motor of the ESP assembly, via the controller, to perform a pumping operation; and pumping fluids, via the production tubing, i) from the formation to a surface location or ii) from the surface location to the formation.

A nineteenth embodiment, which is an electrical submersible pump (ESP) assembly, comprising a graphite seal ring; a first component with the graphite seal installed on an external seal surface; a second component with an internal seal surface aligned with the graphite seal; an activation force; wherein the activation force is configured to: applying a force to the graphite seal in an installation configuration on the external seal surface via the second component; transforming the graphite seal from an activation configuration to a sealing configuration; and wherein the graphite seal is in sealing contact with the external seal surface and the internal seal surface in the sealing configuration.

A twentieth embodiment, which is the ESP assembly of the nineteenth embodiment, further comprising a retaining mechanism configured to retain the graphite seal in the sealing configuration.

A twenty-first embodiment, which is the ESP assembly of the nineteenth or the twentieth embodiment, wherein the retaining mechanism is selected from a group comprising i) a threaded connection with a shoulder, ii) a threaded connection with a retaining ring, iii) a pinned connection, iv) a bolted connection, and v) an interference connection.

A twenty-second embodiment, which is the seal mechanism of the fourth embodiment, wherein the first component with the external seal surface is a stator, and wherein the second component with the internal sealing surface is a first housing, and the third component is a second housing, for example as shown in FIG. 4.

A twenty-third embodiment, which is the seal mechanism of the sixth embodiment, wherein the first component with the external sealing surface is an end cap, and wherein the second component with the internal sealing surface is a second housing, for example as shown in FIG. 5.

A twenty-fourth embodiment, which is the seal mechanism of the eighth embodiment, wherein the first component with the external seal surface is a bottom flange, and wherein a second component with an internal seal surface is a first housing, for example as shown in FIG. 6.

A twenty-fifth embodiment, which is the seal mechanism of the tenth embodiment, wherein the first component with the external seal surface is a seal section housing, and wherein the second component with the internal seal surface is a flange boss, for example as shown in FIG. 7.

A twenty-sixth embodiment, which is the ESP assembly of any of the first through the thirteenth embodiments and the nineteenth through the twenty-first embodiments, wherein an ESP assembly comprising at least one graphite ring in the sealing configuration is conveyed into a wellbore penetrating a subterranean formation via tubing, and wherein the ESP assembly is configured to perform a pumping operation within the wellbore to i) lift fluids from the formation to a surface location via the tubing or ii) pump fluids from the surface location to the formation via the tubing.

While embodiments have been shown and described, modifications thereof can be made by one skilled in the art without departing from the spirit and teachings of this disclosure. The embodiments described herein are exemplary only, and are not intended to be limiting. Many variations and modifications of the embodiments disclosed herein are possible and are within the scope of this disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=Rl+k*(Ru−Rl), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the embodiments of the present disclosure. The discussion of a reference herein is not an admission that it is prior art, especially any reference that may have a publication date after the priority date of this application. The disclosures of all patents, patent applications, and publications cited herein are hereby incorporated by reference, to the extent that they provide exemplary, procedural, or other details supplementary to those set forth herein.

What is claimed is:

1. A seal mechanism for an electric submersible pump (ESP) assembly, comprising:

a first housing;

a second housing;

a graphite ring; and a spacer ring, wherein the graphite ring is installed between an outer circumferential seal surface of the first housing and an inner circumferential seal surface of the second housing, wherein the graphite ring forms a seal between the outer circumferential seal surface and the inner circumferential seal surface, wherein an external thread of the first housing is threaded to an internal thread of the second housing, wherein a first axial surface of the spacer ring abuts a first axial surface of the graphite ring, wherein a second axial surface of the spacer ring abuts an axial surface of the second housing, and wherein a second axial surface of the graphite ring abuts an axial surface of the first housing.

2. The seal mechanism of claim 1, wherein the graphite ring is made of at least 98% graphite.

3. The seal mechanism of claim 1, wherein:

a cross-section of the ring comprises a square shape, a quadrilateral shape, or a hexagonal shape.

4. The seal mechanism of claim 1, wherein:

the graphite ring forms a seal within a threaded connection between the first housing and the second housing.

5. The seal mechanism of claim 1, wherein the first housing has a receiving port configured to receive a retaining bolt.

6. The seal mechanism of claim 1, wherein the second housing has a receiving port configured to receive a retaining bolt.

7. The seal mechanism of claim 1, wherein:

the graphite ring forms a seal within a bolted joint;

the first housing has a plurality of ports through a flange boss; and the second housing has a plurality of threaded ports.

8. The seal mechanism of claim 7, wherein:

a plurality of retainer bolts are installed through the plurality of ports through the flange boss and into the plurality of threaded ports.

9. The seal mechanism of claim 1, wherein:

the graphite ring forms a seal within an interference connection; and the graphite ring is installed on the first housing, an external receiving surface, and a retaining ring.

10. The seal mechanism of claim 9, wherein:

the inner circumferential seal surface is disposed over the graphite ring and the external receiving surface.

11. The seal mechanism of claim 1, wherein the ESP assembly comprises a pump section housing, an intake section housing, a seal section housing, a motor section housing, a sensor package housing, or any combination thereof, and wherein the motor section housing comprises the first housing and the second housing.

12. The seal mechanism of claim 1, wherein the graphite ring is located within one or more sections of the ESP assembly.

13. A method of forming a seal within an Electric Submersible Pump (ESP) assembly, comprising:

installing a graphite ring in an installation configuration onto an outer circumferential seal surface of a first housing of the ESP assembly;

positioning a second housing to align an inner circumferential seal surface of the second housing with the graphite ring; and transforming the graphite ring from the installation configuration to a sealing configuration by applying an activation force to the graphite ring, wherein the graphite ring forms a seal to the outer circumferential seal surface and the inner circumferential seal surface in the sealing configuration, wherein the graphite ring is installed between the outer circumferential seal surface of the first housing and the inner circumferential seal surface of the second housing, wherein an external thread of the first housing is threaded to an internal thread of the second housing, wherein a first axial surface of a spacer ring abuts a first axial surface of the graphite ring, wherein a second axial surface of the spacer ring abuts and an axial surface of the second housing, and wherein a second axial surface of the graphite ring abuts an axial surface of the first housing.

14. The method of claim 13, wherein:

the activation force is an axial force that is applied by an external fixture to the first housing and the second housing;

the activation force is applied through a the spacer ring into the graphite ring; and a retaining bolt installed through a housing port of the second housing and into a receiving port of the first housing retains the activation force within the pinned connection.

15. The method of claim 13, wherein the external threads and the internal threads are part of a retaining mechanism configured to retain the graphite ring in the sealing configuration.

16. The method of claim 15, wherein the retaining mechanism further comprises a pinned connection, a bolted connection, or an interference connection.

17. The method of claim 13, wherein the activation force is further provided by an external fixture, a plurality of retaining bolts threadingly coupling the first housing to the second housing via anchoring ports, thermally cooling the second housing from an elevated temperature to generate an interference fit, or thermally warming the first housing from a reduced temperature to generate an interference fit.

18. The method of claim 13, further comprising:

coupling the ESP assembly to a tubing;

electrically coupling an electric motor of the ESP assembly to a controller via a power cable;

conveying the ESP assembly, via the tubing, into a wellbore penetrating a subterranean formation;

controlling the electric motor of the ESP assembly, via the controller, to perform a pumping operation; and pumping fluids, via the tubing, from the formation to a surface location or from the surface location to the formation.

19. An electrical submersible pump (ESP) assembly, comprising:

a spacer ring;

a first housing comprising an outer circumferential seal surface;

a second housing comprising an inner circumferential seal surface; and a graphite seal ring installed between the outer circumferential seal surface and the inner circumferential seal surface, wherein the graphite seal ring is in sealing contact with the outer circumferential seal surface and the inner circumferential seal surface, wherein an external thread of the first housing is threaded to an internal thread of the second housing, wherein a first axial surface of the spacer ring abuts a first axial surface of the graphite seal ring, wherein a second axial surface of the spacer ring abuts and an axial surface of the second housing, and wherein a second axial surface of the graphite seal ring abuts an axial surface of the first housing.

20. The ESP assembly of claim 19, wherein the external thread and the internal thread are part of a retaining mechanism configured to retain the graphite seal ring in the sealing configuration.

21. The ESP assembly of claim 20, wherein the retaining mechanism further comprises a shoulder, a retaining ring, a pinned connection, a bolted connection, or an interference connection.

* * * * *